US011641068B2

(12) United States Patent
Porte et al.

(10) Patent No.: US 11,641,068 B2
(45) Date of Patent: May 2, 2023

(54) ELECTRICAL CRIMP TERMINAL FOR ELECTRICAL WIRE

(71) Applicant: APTIV TECHNOLOGIES LIMITED, St. Michael (BB)

(72) Inventors: Maxime Porte, Nuremberg (DE); Gert Droesbeke, Erkrath (DE)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 17/507,770

(22) Filed: Oct. 21, 2021

(65) Prior Publication Data

US 2022/0131282 A1 Apr. 28, 2022

(30) Foreign Application Priority Data

Oct. 26, 2020 (EP) ..... 20203762

(51) Int. Cl.
*H01R 4/18* (2006.01)
*H01R 4/70* (2006.01)
*H01R 43/048* (2006.01)

(52) U.S. Cl.
CPC ..... *H01R 4/185* (2013.01); *H01R 4/70* (2013.01); *H01R 43/048* (2013.01)

(58) Field of Classification Search
CPC ..... H01R 4/185; H01R 4/70; H01R 43/048
USPC ..... 439/877
See application file for complete search history.

(56) References Cited

U.S. PATENT DOCUMENTS 5,561,267 A * 10/1996 Fudoo ..... H01R 13/052 174/94 R
7,008,274 B2 * 3/2006 Hayashi ..... H01R 4/185 439/877
7,121,903 B2 10/2006 Sakaguchi et al.
7,306,495 B2 * 12/2007 Hashimoto ..... H01R 4/185 439/877
7,775,842 B2 * 8/2010 Yamagami ..... H01R 4/185 439/877

(Continued)

FOREIGN PATENT DOCUMENTS

DE 20008544 U1 7/2000
DE 102013203796 A1 9/2014

(Continued)

OTHER PUBLICATIONS

European Search Report for European Application No. 20203762.8 dated Apr. 13, 2021.

(Continued)

*Primary Examiner* — Peter G Leigh
(74) *Attorney, Agent, or Firm* — Carlson, Gaskey & Olds, P.C.

(57) ABSTRACT

An electrical crimp terminal for connection with a conductor of an electrical cable has an insulation surrounding the conductor. The electrical crimp terminal comprises a conductor connection portion, wherein the conductor connection portion comprises conductor crimp wings for being crimped onto the conductor of the electrical cable. Each of the conductor crimp wings in the non-crimped state has at least one progressive portion having a progressively increasing height in a longitudinal direction to a tip of the conductor to be crimped, wherein the progressive portion extends along the complete length of each conductor crimp wing.

20 Claims, 7 Drawing Sheets

(56) References Cited

U.S. PATENT DOCUMENTS

| | | | | |
|---|---|---|---|---|
| 8,070,536 | B2 * | 12/2011 | Ono | H01R 4/188 439/877 |
| 9,397,410 | B2 * | 7/2016 | Corman | H01R 4/185 |
| 10,594,048 | B2 * | 3/2020 | Bluemmel | H01R 4/188 |
| 2013/0231012 | A1 | 9/2013 | Lengert et al. | |

FOREIGN PATENT DOCUMENTS

| | | | | | |
|---|---|---|---|---|---|
| DE | 112013002610 | T5 | | 2/2015 | |
| DE | 102014204358 | A1 | | 9/2015 | |
| DE | 102015224219 | A1 | | 6/2017 | |
| DE | 102017218105 | A1 | | 4/2018 | |
| EP | 1536518 | A1 | * | 6/2005 | H01R 4/185 |
| EP | 1993171 | A1 | * | 11/2008 | H01R 13/58 |
| EP | 2214263 | A1 | * | 8/2010 | H01R 4/185 |
| EP | 2472675 | A1 | * | 7/2012 | H01R 4/185 |
| EP | 1635426 | B1 | | 3/2013 | |
| EP | 2965383 | B1 | | 12/2019 | |
| GB | 2455655 | A | * | 6/2009 | H01R 4/184 |
| JP | 5282462 | B2 | | 9/2013 | |
| WO | 2009115860 | A1 | | 9/2009 | |
| WO | WO-2009115860 | A1 | * | 9/2009 | H01R 4/184 |
| WO | 2015060161 | A1 | | 4/2015 | |
| WO | WO-2015053182 | A1 | * | 4/2015 | H01R 4/188 |

OTHER PUBLICATIONS

European Search Report for European Application No. 21204176.8 dated Mar. 4, 2022.

* cited by examiner

ELECTRICAL CRIMP TERMINAL FOR ELECTRICAL WIRE

CROSS-REFERENCE TO RELATED APPLICATIONS

This application claims priority to European Patent Application No. EP20203762.8 filed on Oct. 26, 2020.

TECHNICAL FIELD

The present invention relates to the field of electrical crimp terminals, where a conductor of an electrical cable is mechanically and electrically connected to an electrical terminal, electrical connector or the like. The connection is done mechanically by forming a sheet metal element around the electrical cable.

BACKGROUND

Electrical crimp terminals are widely used for connecting an electrical cable to an electrical connector, for example in the production of wire harnesses for the automotive industry.

Examples of electrical connectors with electrical crimp terminals are known for example from the documents JP 5282462 B2, DE 10 2017 218 105 A1, DE 11 2013 002 610 T5, DE 10 2013 203 796 A1 DE 10 2017 218 105 A1, DE 10 2015 224 219 A1, EP 1 635 426 B1, U.S. Pat. No. 7,121,903 B2, DE 10 2014 204 358 A1, EP 2 965 383 B1. In these documents the electrical crimp terminal is particularly shaped to provide particular advantages, i.e. strengthening the connector between insulation connection portion and core connection portion. Further related art can be found in DE 200 08 544 U1, WO 2015/060161 A1, WO 2009/115860 A1, and US 2013/231012 A1.

However, such electrical crimp terminals of the prior art nevertheless may show a low crimp performance in terms of electrical and mechanical reliability. Thus, they may be prone to failure due to a disconnection between wire and connector. Further, some crimp terminals comprise a L-shaped geometry in a non-crimped condition, which requires two distinct crimp portions in the conductor or core crimp area. Therefore, such L-shaped geometry requires more space or terminal length due to the space between the two crimp portions and special tools for crimping such terminals. Other electrical crimp terminals even require three distinct crimp portions for crimping the conductor.

Thus, there is a need to improve the mechanical and electrical reliability of an electrical crimp terminal without increasing the size of the electrical connector and without requiring special tools for crimping.

SUMMARY OF THE DISCLOSURE

The above-mentioned problems are solved by an electrical crimp terminal for connection with a conductor of an electrical cable having an insulation surrounding the conductor, the electrical crimp terminal comprising a conductor connection portion, wherein the conductor connection portion comprises conductor crimp wings to be crimped onto the conductor of the electrical cable; wherein each of the conductor crimp wings in the non-crimped state have at least one progressive portion having a progressively increasing height h(L) in a longitudinal direction L to a tip of the conductor to be crimped.

By having conductor crimp wings that comprises a progressive portion with a height that increases along the longitudinal direction of the electrical crimp terminal, the wire compression onto the conductor increases along the length of the crimp terminal from a low wire compression at the rear of the conductor connection portion to a high wire compression at the front of the conductor connection portion. This progressive wire compression results from providing more material of the conductor crimp wings towards the tip of a conductor to be crimped and using a standard crimping tool with a standard terminal crimp barrel.

Having such a progressive core crimp geometry provides a perfect a smooth wire compression with optimal electrical and mechanical crimp performances. Because of the lower wire compression at the insertion end/rear of the conductor connection portion further the risk for breaking the conductor during wire pull out test is significantly reduced.

In addition, the electrical crimp terminal according to the present disclosure is compatible with existing standard terminal crimp barrels and does not require tool changes as for the crimp terminals with two or more distinct crimping portions for the conductor. This safes effort and costs for providing special tooling.

Further, the progressive core crimp geometry of the conductor connection portion of the electrical crimp terminal according to the present disclosure does not require more space than a conventional crimp terminal. Thus, no design changes are required for the devices to be connected.

The progressive portion of at least one conductor crimp wing may comprises at least one notch. It is possible that the progressive portion of both conductor crimp wings comprises at least one notch. A notch is an interruption or indentation of the progressive portion. The notch divides the smooth reduction of the compaction level of the progressive portion into two parts or compaction areas. For example, wire compression at a rear of the conductor connection portion may lowest and wire compression at a front may be highest. The notch allows these two areas to be mechanically decoupled. This effects improved mechanical strain relief and shock-absorption properties while still ensuring a good electrical connection. For example, the micromovement of the conductor may be kept away from the high compression area. For example, if the conductor is used for signal transmission, an impedance mismatch can thus be reduced, and therefore reflections of the signal can be reduced which leads to higher data transmission rates and better signal integrity.

The notch may comprise a depth d which is less than 50% of the height h(L) of the progressive portion at the position of the notch. Such a notch can be referred to a shallow notch and can effect preferred shock-absorption properties while ensuring that mechanical stability is maintained. The greater the depth, the better the shock-absorption properties but at the same time the mechanical stability can start to become affected. A preferred depth d is between 5 and 40%, more preferred 5% and 20%, most preferred 5% to 15% of the height h(L) of the progressive portion at the position of the notch.

The notch may comprise a notch width w, wherein the notch width w is less than 50% of the complete length l of the conductor crimp wings. The greater the notch width, the more the high-compression area becomes isolated from the low-compression area. However, if the width is too large, the crimp becomes unstable. A preferred width w is about 5 to 35%, more preferred 10 to 25%, most preferred 10 to 15% of the complete length l of the conductor crimp wing.

The contour of the notch may comprise any suitable shape. For example, the contour may be of a circular shape (then the depth d=the width w, both measured in mm), essentially circular shape (then the depth d the width w, both measured in mm) or of an elliptical shape (d≠w, both measured in mm). The term "essentially circular shape" means allowing for deviations of about 10% in width or depth from a circular shape. An essentially circular shape may offer improved shock-absorption properties. It is also possible that the contour of the notch has a parabolic or hyperbolic shape.

The progressive portion of at least one, or of both of the conductor crimp wings may comprise more than one notch, for example, two, three, or four notches. The notches may be similar in structure, such as their depth and width or their structure, e.g. their respective depth or width may be different. It may be particularly advantageous to have several notches per conductor crimp wing as it allows for a gradual mechanical decoupling of a highest-compression area from a lowest-compression area.

The progressive portion extends along the complete length l of each conductor crimp wing. Thus, from the rear to the front of the conductor connection portion the compression force onto the conductor increases linearly. The conductor crimp wings may have the same length or substantially the same length, wherein substantially the same length means the same length within allowable deviations of about 10%.

Alternatively, it is possible that the progressive portion extends only along at least 50%, preferably at least 60%, preferably at least 70%, preferably at least 80% and preferably at least 90% of the length l of the conductor crimp wings.

In one example, the height h of the progressive portion increases linearly. This provides for a substantially linear increase in compression force along the length of the crimp terminal.

In one example, the height h of the progressive portion increases non-linearly. Depending on the diameter and material of the conductor a non-linear increase in height h of the progressive portion and thus a non-linear increase in compression force onto the conductor along the length of the crimp terminal may be selected to provide optimized crimping performance.

In one example, the conductor crimp wings, in the non-crimped state, at the progressive portion comprise an upper edge that is slanted by an angle α.

In one example, the angle α ranges from 2° to 30°, preferably from 2° to 20°, more preferably from 2° to 15° and most preferably from 5° to 15°. Thus, the linear increase of the compression force onto the conductor can be adjusted by the angle α of the slanted upper edge of the progressive portion and adapted to different conductor diameters, conductor types, i.e., solid or strand wire, and materials.

In one example, the conductor connection portion further comprises a conductor connection bottom portion, wherein the conductor crimp wings are integrally connected with their respective lower edges to the conductor connection bottom portion.

In one example, the electrical crimp terminal further comprises an insulation connection portion, mechanically connected with the conductor connection portion, wherein the insulation connection portion comprises insulation crimp wings to be crimped onto the insulation of the electrical cable. The insulation connection portion further significantly increases mechanical stability of the electrical crimp terminal. Preferably, the insulation connection portion is to be crimped structurally independent from the conductor connection portion.

In one example, the insulation connection portion further comprises an insulation connection bottom portion, wherein the insulation crimp wings are integrally connected with their respective lower edges to the insulation connection bottom portion. Preferably, the insulation connection bottom portion is connected with the conductor connection bottom portion.

In one example, the transition between the upper edge and a front side edge and/or a rear side edge of the crimp wings is rounded. Such rounded transition avoids excessive compression force at the rear and at the front end of the conductor connection portion and thus further reduces the risk of breaking the crimped conductor.

In one example, the transition between the upper edge and the rear side edge and/or the front side edge of the crimp wings is rounded by a radius r1, r2, respectively, that preferably ranges from 3% to 20%, more preferably from 5% to 20% or most preferably from 5% to 10% of the length l of the conductor crimp wings.

In one example, the crimp wings along the upper edge thereof, comprise a chamfer. This chamfer facilitates introduction of the crimp wings into the strands of the conductor and thus facilitates the crimping process.

In one example, the chamfer 19 is slanted by an angle β with respect to the plane of the crimp wings, wherein the angle β ranges from 10° to 40°, preferably from 20° to 30°.

BRIEF DESCRIPTION OF THE DRAWINGS

In the following, embodiments of the present disclosure are disclosed by reference to the accompanying figures, in which shows.

DESCRIPTION OF PREFERRED EMBODIMENTS

In the following preferred embodiments of the present disclosure are described with respect to the figures.

Figure 1:
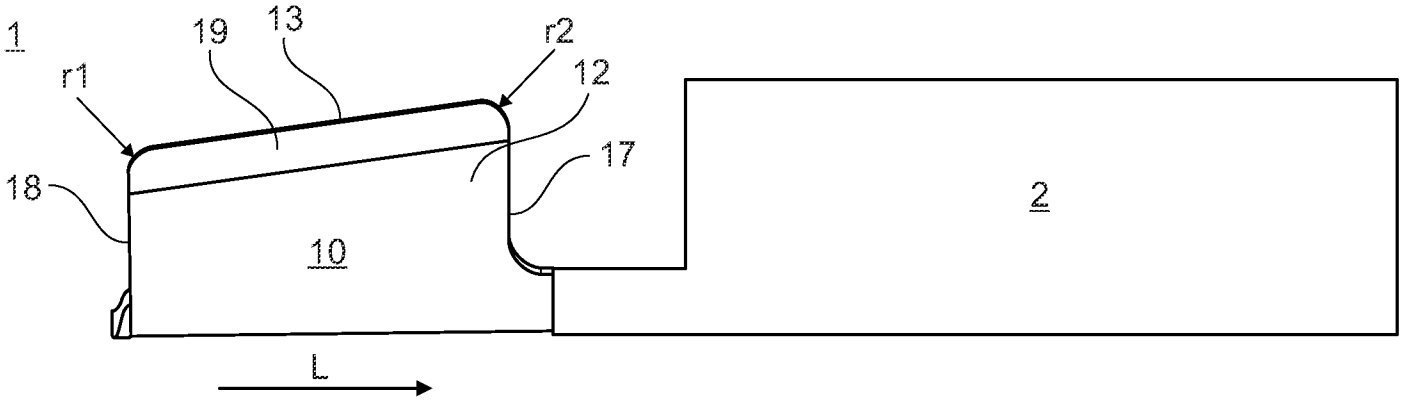
FIG. 1: a side view of an embodiment of an electrical crimp terminal in a non-crimped state.
Figure 2:
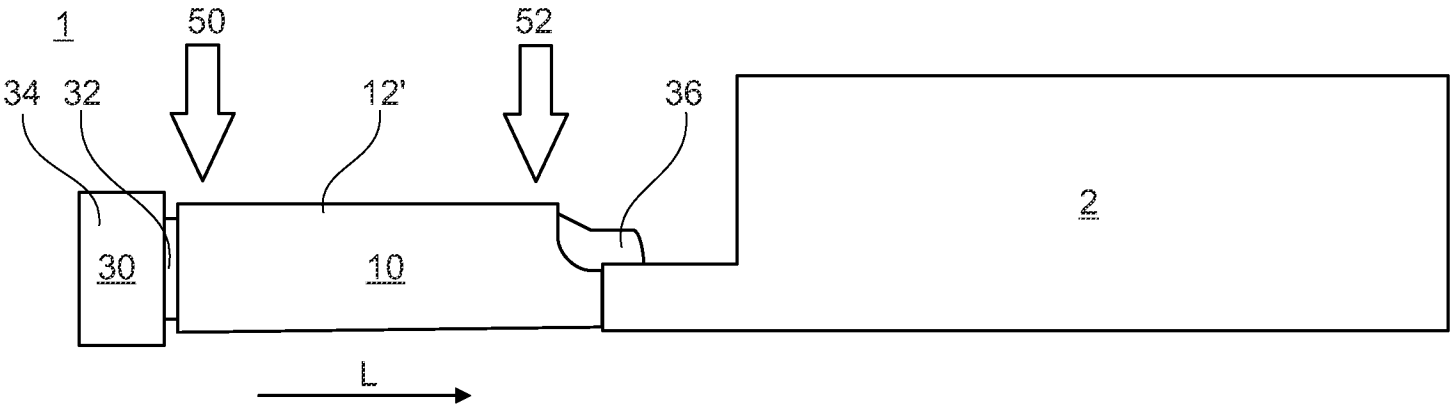
FIG. 2: a side view of the embodiment FIG. 1 together with an electrical cable in a crimped state.

FIG. 1 shows a side view of an exemplary electrical crimp terminal 1 in a non-crimped state. FIG. 2 shows a side view of the electrical crimp terminal 1 of FIG. 1 in a state crimped to an electrical cable 30. A corresponding essentially flat blank of the electrical crimp terminal 1 is shown in FIG. 8.

Figure 7:
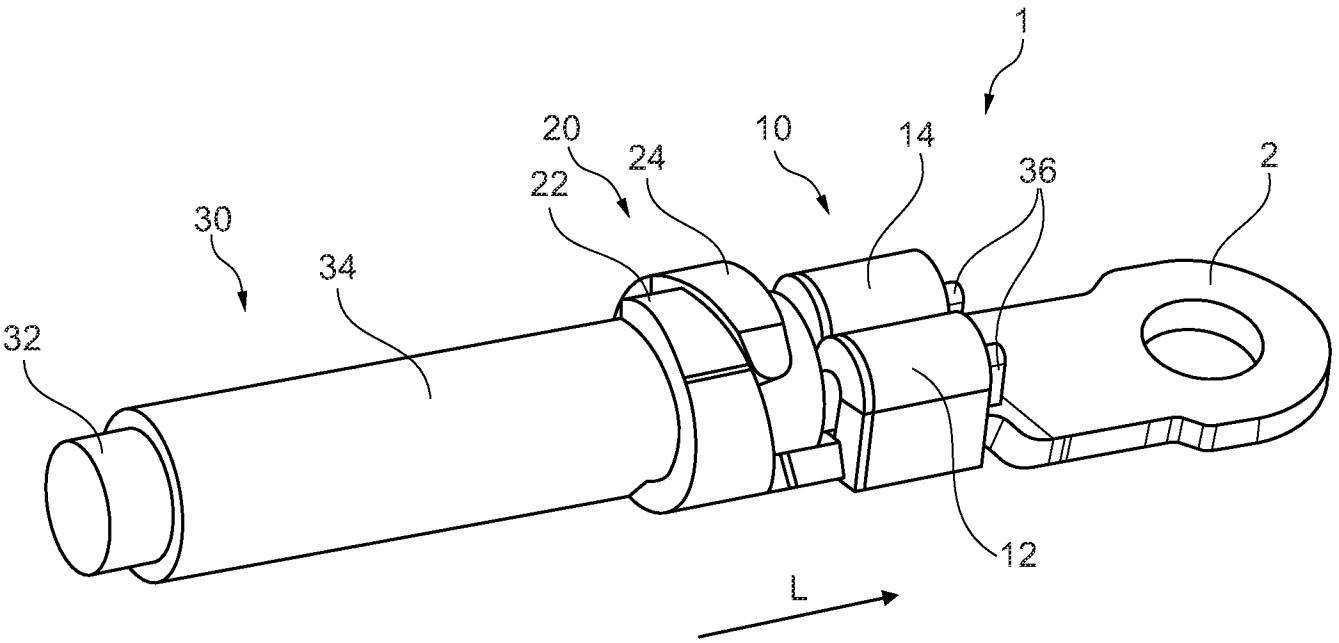
FIG. 7: a three-dimensional view of the electrical crimp terminal of FIG. 6 together with an electrical cable in a crimped state.

The electrical crimp terminal 1 comprises a conductor connection portion 10 with two oppositely arranged conductor crimp wings 12, 14 for connection to an electrical cable 30 (see FIG. 2). The electrical crimp terminal 1 further comprises an arbitrary terminal contacting area 2, that can for example be in form of a fork, a lug (see. FIG. 7), a plug, a pin, a socket or in a different form as required for the electrical connector. In FIG. 8 the terminal contacting area 2 is only shown partially.

Figure 3:
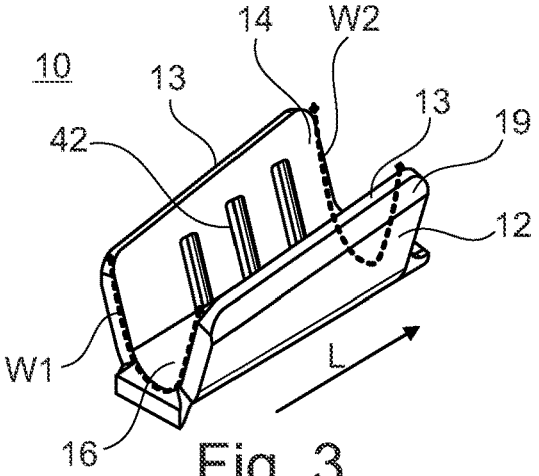
FIG. 3: a three-dimensional view of a conductor connection portion of the electrical crimp terminal of FIG. 1.
Figure 8:
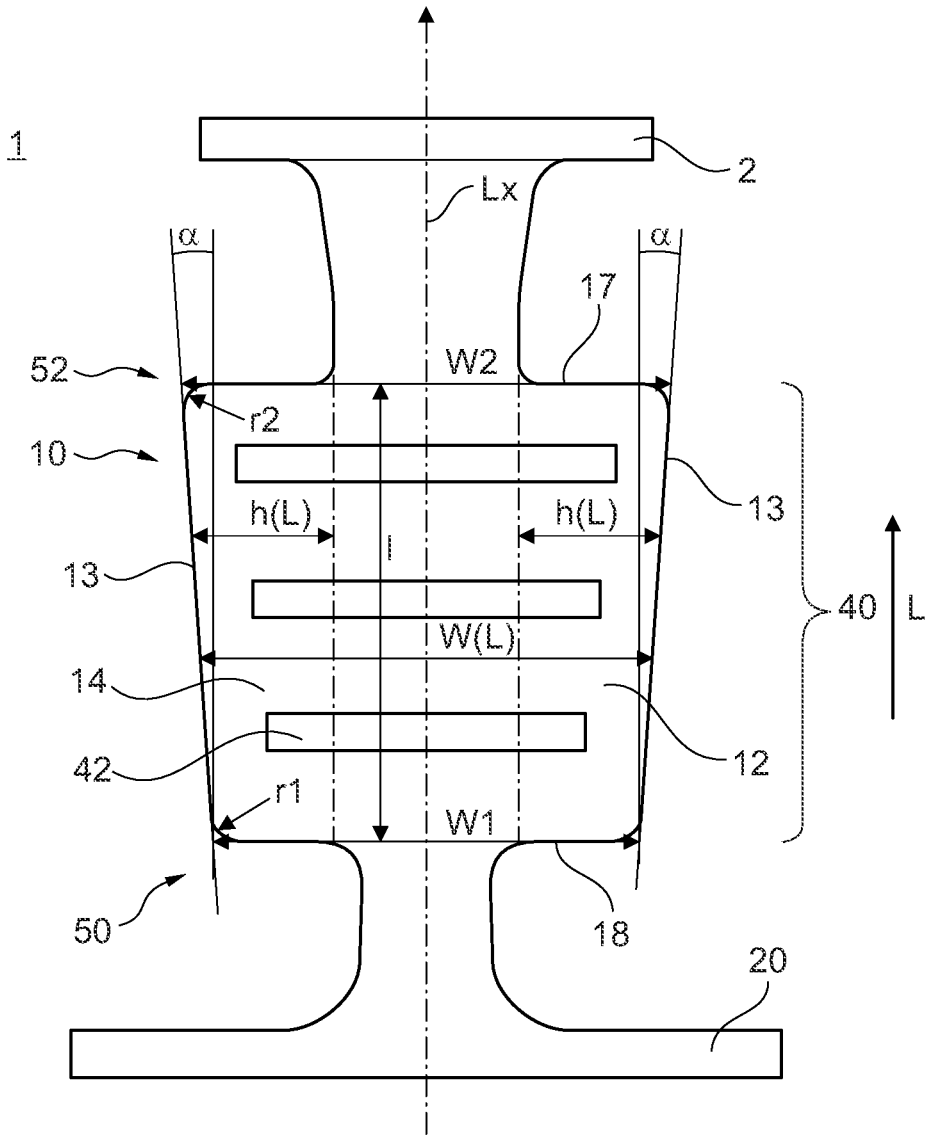
FIG. 8: a partial plan view of a stamped flat blank of the electrical crimp terminal of FIG. 1.

The electrical crimp terminal 1 is usually made of a sheet metal, e.g. out of copper or brass or other suitable metal, stamped out of the sheet metal and bent from an essential flat blank as shown in FIG. 8 into the non-crimped form as shown in FIGS. 1, 3, 4, 5 and 6. Referring to FIG. 3, a right conductor wing 12 and a left conductor wing 14 are to be crimped around a conductor 32 of the electrical cable 30 for providing an electrical and mechanical connection of the electrical crimp terminal 1 with the electrical cable 30.

Figure 4:
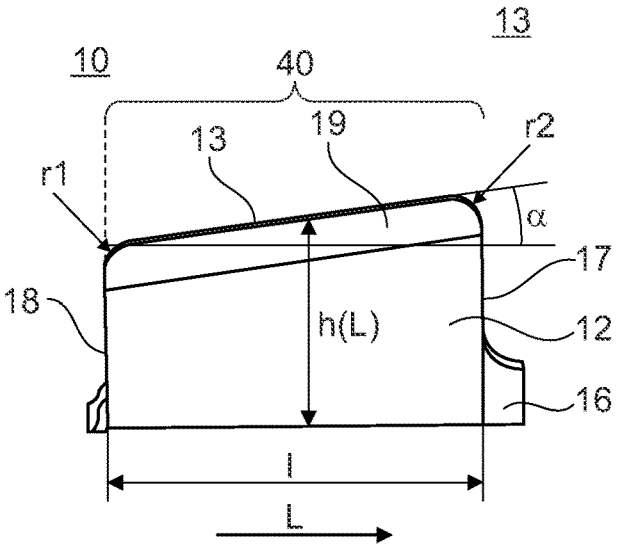
FIG. 4: a side view of the conductor connection portion of FIG. 3.
Figure 5:
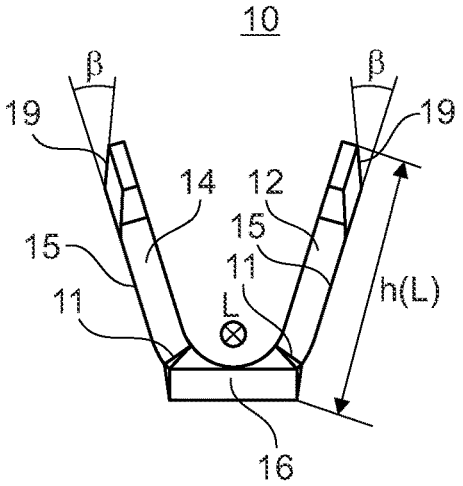
FIG. 5: a plane view from the rear of the conductor connection portion of FIG. 3.

As shown in FIG. 1 and in more detail in FIGS. 3 to 5 the two conductor wings 12, 14 in the non-crimped state have at least one progressive portion 40 having a progressively increasing height h(L) in a longitudinal direction L to a tip 36 of a conductor 32 of the cable 30 to be crimped. The longitudinal direction L extends parallel to the longitudinal axis Lx of the electrical crimp terminal 1, see FIG. 8. The longitudinal axis Lx and the longitudinal direction L is further parallel to the longitudinal axis of the electrical cable 30 crimped within the electrical terminal 1.

Thus, the height h(L) depends on the longitudinal direction L and progressively increases along the longitudinal axis of the electrical cable 30 to the tip 36 of the conductor. This means that from the rear 50 of the progressive portion 40 facing the electrical cable 30 to the front 52 of the progressive portion 40 facing a tip 36 of the conductor 32, the height h(L) of the conductor wings 12, 14 increases. Thus, progressively more material to be crimped is provided from the rear 50 to the front 52 of the conductor connection portion 10. Therefore, when the conductor connection portion 10 is crimped by a standard crimping tool around the conductor 32 as shown in FIG. 2, the wire compression at the rear 50 of the conductor connection portion 10 is lowest and the wire compression at the front 52 is highest.

As shown in FIG. 1 and FIG. 4 an upper edge 13 of the conductor wings 12, 14 from left to right is slanted upwards by an angle $\alpha$ to a horizontal plane in the longitudinal direction L and is straight. Thus, also the wire compression is linearly increasing from the rear 50 to the front 52 of the conductor connection portion 10. Preferably the angle $\alpha$ can range from 2° to 30°, preferably from 2° to 20°, more preferably from 2° to 15° and most preferably from 5° to 15°. The angle $\alpha$ can depend on the type, diameter and material of the conductor 32 and a length l of the conductor crimp wings 12, 14 or the length of the progressive portion 40.

As shown in FIGS. 3 and 8, preferably, the extended width W(L) of a blank forming the progressive portion 40 of the conductor connection portion 10 increases along the longitudinal direction L preferably from the rear 50 to the front 52 of the progressive portion from a minimal extended width W1 to a maximal extended width W2. Preferably, the maximal extended width W2 at the front side edge 17 of the progressive portion 40 is at least 15% longer than the minimal extended width W1 at the rear side edge 18. Preferably, the extended width W2 is from 15%-50% and more preferred about 25% longer than the extended width W1.

It is preferred that the progressive portion 40 of the conductor connection portion 10 extends along the complete length l of the conductor crimp wings 12, 14. However, it should be noted that the progressive portion 40 of the conductor connection portion 10 can also extend only along a part of the length l conductor connection portion 10 or the conductor crimp wings 12, 14. Preferably, the progressive portion 40 can extend along at least 50%, preferably at least 60%, preferably at least 70%, preferably at least 80% and preferably at least 90% of the length l of the conductor crimp wings 12, 14. By such a design the compression force can be variably set along the length l of the conductor connection portion 10 with areas of constant compression force and areas with progressively increasing compression force. Further, it is possible to provided more than one, for example, two or three, individual progressive portions 40 at one conductor crimp wing 12, 14. This can further be used to particularly determine the compression force of the crimped conductor connection portion.

Further, the height h(L) of the progressive portion 40 can linearly increase, as particularly shown in FIGS. 1, 4 and 8 but other non-linear increases of the height h(L) can also be possible. Thus, for example, exponential or hyperbolic increases of the height h(L) of the progressive portion 40 can be used.

As shown in FIGS. 3 and 5 the conductor connection portion 10 further comprises a conductor connection bottom portion 16, wherein the two conductor crimp wings 12, 14 are integrally connected with their respective lower edge 11 to the conductor connection bottom portion 16. The conductor connection bottom portion 16 may be curved or rounded in section on the top-side to fit to the original shape of the conductor 32 and to provide a good transition of the conductor connection bottom portion 16 to the conductor crimp wings 12, 14.

As shown in FIGS. 1 and 4 the transition between the upper edge 13 and a front side edge 17 and/or a rear side edge 18 of the crimp wings 12, 14 can be rounded. Preferably, the transition is rounded by a radius r1, r2, respectively, that preferably ranges from 3% to 20%, more preferably from 5% to 20% or most preferably from 5% to 10% of the length l of the conductor crimp wings 12, 14. Particularly, the rounded transition at the rear of the conductor connection portion 10 having a radius r1 facilitates a smooth application of the compression force to the conductor 32 in this area. This further decreases the risk of a break or weakening of the conductor 32.

Further, as particularly shown in FIG. 5 the crimp wings 12, 14 along the upper edge 13 thereof, may comprise a chamfer 19 that may facilitate crimping of the conductor connection area 10. Preferably, the chamfer 19 is slanted by an angle $\beta$ with respect to the plane 15 of the conductor crimp wings 12, 14, wherein the angle $\beta$ ranges from 10° to 40°, preferably from 20° to 30.

Figure 6:
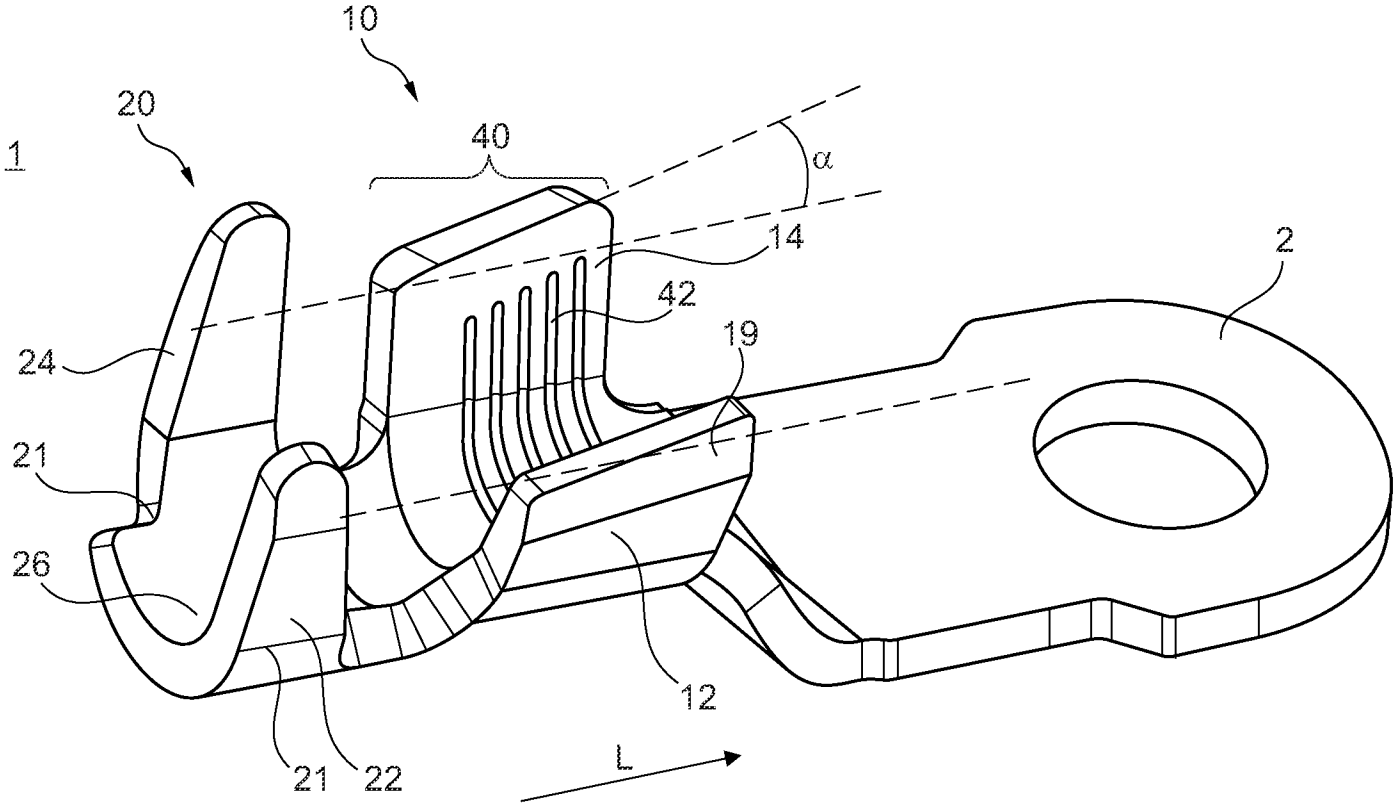
FIG. 6: a three-dimensional view of a further embodiment of an electrical crimp terminal in a non-crimped state.

The conductor crimp wings 12, 14 can further comprise ridges 42, as shown in FIGS. 3 and 6 on the inner sides thereof to improve the holding force for the conductor 32 to be held by the conductor connection portion 10. The ridges 42 deform the outer side of the conductor 32 to provide a form fit of the connection between conductor 32 and the electrical crimp terminal 1.

Figure 11:
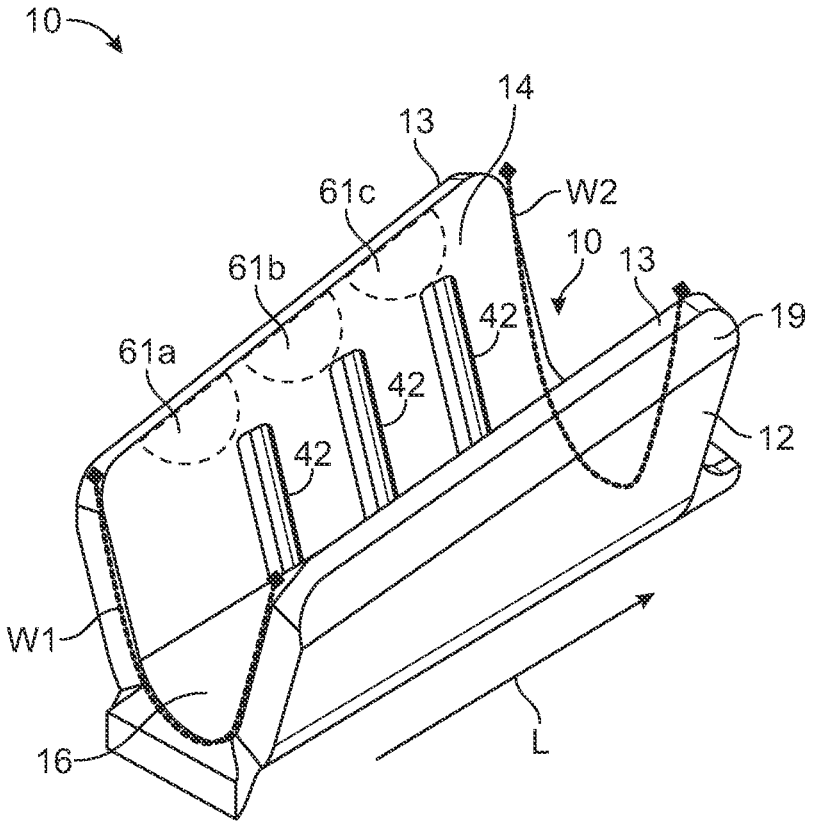
FIG. 11: a three-dimensional view of a conductor connection portion of an electrical crimp terminal, wherein one conductor crimp wing comprises three notches.

If the conductor crimp wings 12, 14 comprise ridges 42 and if one or both conductor crimp wings 12, 14 comprises at least one notch, it is possible and preferable that the ridges 42 do not overlap with any of the notches so that the ridges 42 effect on the holding force is not diminished (FIG. 11 shows one such example).

FIGS. 6 and 7 show a further embodiment of an electrical crimp terminal 1. The electrical crimp terminal 1 of FIGS. 6 and 7 comprises the conductor connection portion 10 as described with respect to FIGS. 1 to 5, and further comprises an insulation connection portion 20 for connecting the terminal 1 with the insulation 34 of the electrical cable 30. The insulation connection portion 20 is mechanically connected with but distanced from the conductor connection portion 10 and comprises a right insulation crimp wing 22 and a left insulation crimp wing 24 arranged on opposite sides of an insulation connection bottom portion 26. The insulation connection bottom portion 26 is curved or rounded in section on the top-side to also fit to the original shape of the insulation 34 and to provide a good transition of the insulation connection bottom portion 26 to the insulation crimp wings 22, 24. The insulation crimp wings 22, 24 are offset from each other, such that they are located side by side in the crimped state, as shown in FIG. 7. The insulation crimp wings 22, 24 are integrally connected with their respective lower edges 21 to the insulation connection bottom portion 16.

The electrical crimp terminal 1 of FIGS. 6 and 7 further comprises a terminal contacting area 2 in the form of a lug area integrally connected to the conductor connection portion 10 in the longitudinal direction L. Of course, other terminal contacting areas 2 can also be provided like for example in the form of a fork, a plug, a pin or a socket.

The electrical cable 30 can be of different types, materials and diameters. The conductor 32 can be stranded and comprise a number of individual wires or the conductor can be made of a single solid wire. Common materials for the conductor 32 are copper, silver coated copper, gold coated copper, tin coated copper, aluminum or other electrically conducting materials. The insulation 34 commonly consists of a non-conducting plastic material.

Figure 9:
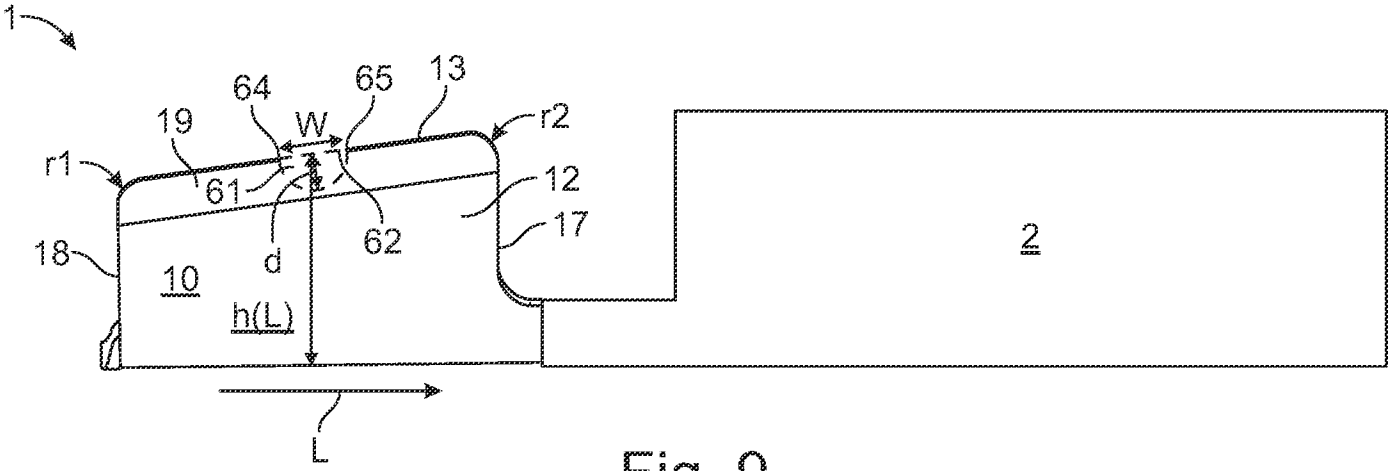
FIG. 9: a side view of an embodiment of an electrical crimp terminal in a non-crimped state, comprising a shallow notch.
Figure 10:
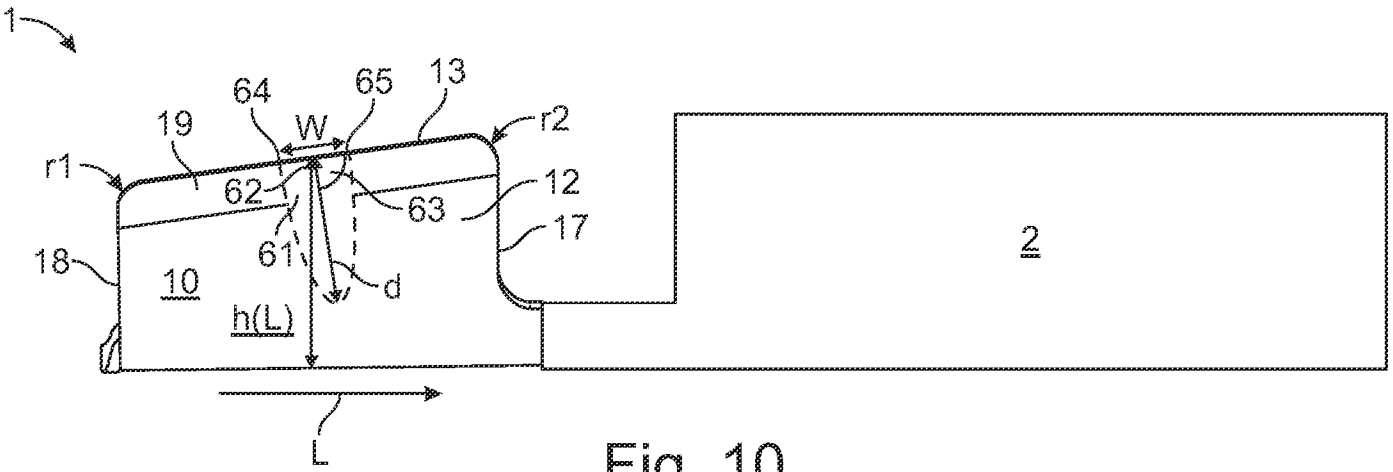
FIG. 10: a side view of an embodiment of an electrical crimp terminal in a non-crimped state, comprising a deep notch.

FIGS. 9 and 10 show a side view of an exemplary electrical crimp terminal 1 in a non-crimped state similar to FIG. 1 described above. The crimping process is similar to that illustrated above, e.g. in the context of FIG. 2. In FIGS. 9 and 10, the progressive portion 40 of each of the two conductor crimp wings 12, 14 comprises a notch 61. The notch 61 comprises a depth d. In this example, the depth d is measured at a right angle 63 from the upper edge of crimp wing 13. In other words, the angle 63 between upper edge of crimp wing 13 and the notch depth d is 90 degrees.

FIG. 9 shows an example of a shallow notch, wherein the depth d is less than 50% of the height h(L) at the longitudinal position 62 of the notch. In this example, the depth d of the notch 61 is about 15% of the height h(L) of the progressive portion at the longitudinal position 62 of the notch. In the context a crimp terminal 1 comprising a notch, the height h(L) is the fictional height at the position 62 of the upper edge of crimp wing 13 if the notch 61 were not present and can be constructed by drawing a straight line through the first lateral end 64 and the second lateral end 65 of the notch 61. The longitudinal position 62 of the notch is measured at the centre of the notch as indicated. The contour of the notch 61 comprises an essentially circular shape, i.e. the depth d the width w (both measured in mm) of the notch 61.

FIG. 10 shows an example of a deep notch, wherein the depth d is at least 50% of the height h(L) at the longitudinal position 62 of the notch. In this example, the depth d is about 60% of the height h(L) at the longitudinal position 62 of the notch. Since the depth d is measured at a right angle 63 from the upper edge of crimp wing 13, it can be larger than the height h(L) if the slant angle $\alpha \neq 0$. In FIG. 10, the contour of the notch has an elliptical shape ($d \neq w$, both measured in mm).

In FIGS. 9 and 10, the notch 61 comprises a notch width w, wherein the notch width w is less than 50% of the complete length l of each conductor crimp wings 12, 14. In FIGS. 9 and 10, the width w is about 10% of the complete length l of each conductor crimp wing 12, 14. However, it is alternatively possible for the notch width w to be larger than 50% of the complete length l of each conductor crimp wings 12, 14.

FIG. 11 shows a similar view as FIG. 3 shown above. The two conductor wings 12, 14 in the non-crimped state each have a progressive portion 40 having a progressively increasing height h(L) in a longitudinal direction L to a tip 36 of a conductor 32 of the cable 30 to be crimped. In the example of FIG. 11, the progressive portion 40 of the conductor crimp wing 12 comprises three notches 61*a*, 61*b*, and 61*c*, while the opposing conductor crimp wing 14 does not comprise a notch.

The conductor crimp wings 12, 14 comprise ridges 42, as shown in FIG. 11 on the inner sides thereof to improve the holding force for the conductor 32 to be held by the conductor connection portion 10. The ridges 42 deform the outer side of the conductor 32 to provide a form fit of the connection between conductor 32 and the electrical crimp terminal 1. The three notches 61*a*, 61*b*, and 61*c* on the conductor crimp wing 12 are arranged not to overlap with the ridges 42 on the conductor crimp wings 12, so that the holding force effected by the form fit of the connection between conductor 32 and the electrical crimp terminal 1 is not affected adversely.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

The invention claimed is:

1. An electrical crimp terminal for connection with a conductor of an electrical cable having an insulation surrounding the conductor, the electrical crimp terminal comprising a conductor connection portion, wherein the conductor connection portion comprises conductor crimp wings for being crimped onto the conductor of the electrical cable;

wherein each of the conductor crimp wings in the non-crimped state has at least one progressive portion having a progressively increasing height in a longitudinal direction to a tip of the conductor to be crimped, wherein the at least one progressive portion tapers along a complete length of each conductor crimp wing relative to the longitudinal direction.

2. The electrical crimp terminal according to claim 1, wherein the progressive portion of at least one conductor crimp wing comprises at least one notch.

3. The electrical crimp terminal according to claim 2, wherein the notch comprises a depth, which is less than 50% of the height of the progressive portion at the position of the notch.

4. The electrical crimp terminal according to claim 2, wherein the notch comprises a notch width, and wherein the notch width is less than 50% of the complete length of the conductor crimp wings.

5. The electrical crimp terminal according to claim 1, wherein the height of the progressive portion increases linearly.

6. The electrical crimp terminal according to claim 1, wherein the height of the progressive portion increases non-linearly.

7. The electrical crimp terminal according to claim 1, wherein the conductor crimp wings, in the non-crimped state, at the progressive portion comprise an upper edge that is slanted by an angle.

8. The electrical crimp terminal according to claim 1, wherein the conductor connection portion comprises a conductor connection bottom portion, wherein the conductor crimp wings are integrally connected with a respective lower edge to the conductor connection bottom portion.

9. The electrical crimp terminal according to claim 1, comprising an insulation connection portion, mechanically connected with the conductor connection portion, wherein the insulation connection portion comprises insulation crimp wings for being crimped onto the insulation of the electrical cable.

10. The electrical crimp terminal according to claim 9, wherein the insulation connection portion further comprises an insulation connection bottom portion, wherein the insulation crimp wings are integrally connected with their respective lower edge to the insulation connection bottom portion.

11. The electrical crimp terminal according to claim 1, wherein a transition between an upper edge and at least one of a front side edge and a rear side edge of the crimp wings is rounded.

12. The electrical crimp terminal according to claim 1, wherein the crimp wings along an upper edge thereof, comprise a chamfer.

13. The electrical crimp terminal according to claim 12, wherein the chamfer is slanted by an angle with respect to a plane of the crimp wings.

14. An electrical crimp terminal for connection with a conductor of an electrical cable having an insulation surrounding the conductor, the electrical crimp terminal comprising a conductor connection portion, wherein the conductor connection portion comprises conductor crimp wings for being crimped onto the conductor of the electrical cable;

wherein each of the conductor crimp wings in the non-crimped state has at least one progressive portion having a progressively increasing height in a longitudinal direction to a tip of the conductor to be crimped, wherein the at least one progressive portion extends along a complete length of each conductor crimp wing, wherein the conductor crimp wings, in the non-crimped state, at the progressive portion comprise an upper edge that is slanted by an angle, wherein the angle ranges from 2° to 30°.

15. The electrical crimp terminal according to claim 14, wherein the angle ranges from 2° to 20°.

16. The electrical crimp terminal according to claim 15, wherein the angle ranges from 2° to 15°.

17. The electrical crimp terminal according to claim 16, wherein the angle ranges from 5° to 15°.

18. An electrical crimp terminal for connection with a conductor of an electrical cable having an insulation surrounding the conductor, the electrical crimp terminal comprising a conductor connection portion, wherein the conductor connection portion comprises conductor crimp wings for being crimped onto the conductor of the electrical cable;

wherein each of the conductor crimp wings in the non-crimped state has at least one progressive portion having a progressively increasing height in a longitudinal direction to a tip of the conductor to be crimped, wherein the at least one progressive portion extends along a complete length of each conductor crimp wing, wherein a transition between an upper edge and at least one of a front side edge and a rear side edge of the crimp wings is rounded, wherein the transition between the upper edge and the at least one of the rear side edge and the front side edge of the crimp wings is rounded by a radius respectively, that ranges from 3% to 20%, of the length of the conductor crimp wings.

19. The electrical crimp terminal according to claim 18, wherein the transition between the upper edge and the at least one of the rear side edge and the front side edge of the crimp wings is rounded by a radius respectively, that ranges from 3 from 5% to 20% of the length of the conductor crimp wings.

20. The electrical crimp terminal according to claim 19, wherein the transition between the upper edge and the at least one of the rear side edge and the front side edge of the crimp wings is rounded by a radius respectively, that ranges from 5% to 10% of the length of the conductor crimp wings.

* * * * *